US009232604B2

(12) United States Patent
Hikmet et al.

(10) Patent No.: US 9,232,604 B2
(45) Date of Patent: Jan. 5, 2016

(54) COLOR TUNABLE LIGHTING ASSEMBLY, A LIGHT SOURCE AND A LUMINAIRE

(71) Applicant: KONINKLIJKE PHILIPS N.V., Eindhoven (NL)

(72) Inventors: Rifat Ata Mustafa Hikmet, Eindhoven (NL); Ties Van Bommel, Horst (NL); Shu Xu, Shanghai (CN)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/370,379

(22) PCT Filed: Dec. 20, 2012

(86) PCT No.: PCT/IB2012/057505

§ 371 (c)(1),
(2) Date: Jul. 2, 2014

(87) PCT Pub. No.: WO2013/102820

PCT Pub. Date: Jul. 11, 2013

(65) Prior Publication Data

US 2014/0339983 A1 Nov. 20, 2014

Related U.S. Application Data

(60) Provisional application No. 61/582,513, filed on Jan. 3, 2012.

(51) Int. Cl.
*H05B 33/08* (2006.01)
*F21V 9/16* (2006.01)
(Continued)

(52) U.S. Cl.
CPC ..... *H05B 33/0872* (2013.01); *F21V 9/10* (2013.01); *F21V 9/16* (2013.01); *F21V 14/003* (2013.01); *F21V 14/08* (2013.01);
(Continued)

(58) Field of Classification Search
CPC ..... H05B 33/0872; F21V 9/16; F21V 9/10; F21V 29/407
USPC ..... 315/118; 362/97.3, 97.1; 257/89, 98
See application file for complete search history.

(56) References Cited

U.S. PATENT DOCUMENTS

2007/0284994 A1 12/2007 Morimoto et al.
2010/0060143 A1 3/2010 Zimmerman et al.
(Continued)

FOREIGN PATENT DOCUMENTS

DE 102009003936 A1 7/2010
WO 2010129374 A2 11/2010

*Primary Examiner* — Daniel D Chang
(74) *Attorney, Agent, or Firm* — Yuliya Mathis

(57) ABSTRACT

A color tunable lighting assembly (100), a light source and a luminaire are provided. The color tunable lighting assembly (100) comprises a light emitter (110), a luminescent layer (108) and a temperature controlling means (106). The light emitter (110) emits light (112) of a first color distribution. The luminescent layer (108) receives light (112) emitted by the light emitter (110). The luminescent layer (108) comprises luminescent material to absorb a portion of the light (112) of the first color distribution and to convert a portion of the absorbed light into light (102) of a second color distribution. The second color distribution is dependent on the temperature of the luminescent layer (108). The temperature controlling means (106) actively controls a temperature of the luminescent layer (108) to obtain a light emission by the color tunable lighting assembly. The light emission has a specific color distribution.

12 Claims, 10 Drawing Sheets

(51) Int. Cl.

| | |
|---|---|
| ***F21V 29/00*** | (2015.01) |
| ***F21V 14/08*** | (2006.01) |
| ***F21V 9/10*** | (2006.01) |
| ***F21V 14/00*** | (2006.01) |
| ***F21V 23/04*** | (2006.01) |
| ***F21V 29/54*** | (2015.01) |
| ***F21V 29/90*** | (2015.01) |
| *F21K 99/00* | (2010.01) |
| *F21Y 101/02* | (2006.01) |
| *F21Y 105/00* | (2006.01) |
| *F21V 17/02* | (2006.01) |

(52) U.S. Cl.

CPC ..... *F21V 23/0457* (2013.01); *F21V 29/54* (2015.01); *F21V 29/90* (2015.01); *H05B 33/0869* (2013.01); *F21K 9/56* (2013.01); *F21K 9/58* (2013.01); *F21V 17/02* (2013.01); *F21Y 2101/025* (2013.01); *F21Y 2105/008* (2013.01)

(56) References Cited

U.S. PATENT DOCUMENTS

| | | | | |
|---|---|---|---|---|
| 2010/0142189 | A1* | 6/2010 | Hong et al. | 362/97.3 |
| 2010/0328925 | A1 | 12/2010 | Hoelen et al. | |
| 2011/0199753 | A1 | 8/2011 | Ramer et al. | |
| 2011/0215698 | A1 | 9/2011 | Tong et al. | |

* cited by examiner

200

230

260

COLOR TUNABLE LIGHTING ASSEMBLY, A LIGHT SOURCE AND A LUMINAIRE

CROSS-REFERENCE TO PRIOR APPLICATIONS

This application is the U.S. National Phase application under 35 U.S.C. §371 of International Application No. PCT/IB12/057505, filed on Dec. 20, 2012, which claims the benefit of [e.g., U.S. Provisional Patent Application No. or European Patent Application No.] 61/582,513, filed on Jan. 03, 2012. These applications are hereby incorporated by reference herein.

FIELD OF THE INVENTION

The invention relates to color tunable lighting assemblies.

BACKGROUND OF THE INVENTION

Well known color tunable lighting devices comprise, for example, three light emitters each emitting a different primary color. By controlling an amount of light emitted by each one of the three light emitters a specific color may be emitted by such color tunable lighting devices. Other color tunable lighting devices comprise a light emitter and a luminescent element. In such a color tunable lighting device a controllable portion of the light emitted by the light emitter is absorbed by the luminescent element and converted to another color thereby controlling a color of the total light emission of the color tunable lighting device. The known color tunable lighting devices comprise a large number of components and are therefore relatively expensive and relatively complex.

SUMMARY OF THE INVENTION

It is an object of the invention to provide an improved color tunable lighting assembly.

A first aspect of the invention provides a color tunable lighting assembly. A second aspect of the invention provides a light source. A third aspect of the invention provides a luminaire. Advantageous embodiments are defined in the dependent claims.

A color tunable lighting assembly in accordance with the first aspect of the invention comprises a light emitter, a luminescent layer and a temperature controlling means. The light emitter emits light of a first color distribution. The luminescent layer receives light emitted by the light emitter. The luminescent layer comprises luminescent material to absorb a portion of the light of the first color distribution and to convert a portion of the absorbed light into light of a second color distribution. The second color distribution is dependent on the temperature of the luminescent layer. The temperature controlling means actively controls a temperature of the luminescent layer to obtain a light emission by the color tunable lighting assembly. The light emission has a specific color distribution.

Luminescent materials absorb light in accordance with their absorption distribution and emit light according to their light emission distribution (being defined in the invention as the second color distribution). Especially the exact shape of the light emission distribution and the exact position of the light emission distribution in the electromagnetic spectrum depend on the operational temperature of the luminescent material. If the temperature of the luminescent material increases, the light emission distribution shift towards a larger wavelength.

The color tunable lighting device uses this effect to tune the color distribution of its light emission. The light emitter emits light of a first color distribution. A portion of the light of the first color distribution is absorbed. A not absorbed portion of the light of the first color distribution is emitted by the color tunable lighting assembly—the not absorbed portion comprises wavelengths of light which are not present in the absorption distribution of the luminescent material and may comprise wavelengths of light which are present in the absorption distribution, but are not completely absorbed because of a limited amount of luminescent material being present. The luminescent material emits light according to a second color distribution. The amount of light emitted by the luminescent material depends on the amount of absorbed light. Thus, the total light emission by the color tunable lighting assembly, and thus the specific color distribution, comprises a specific amount of light of the second color distribution and light of the first color distribution that was not absorbed by the luminescent material.

The color tunable lighting device comprises the temperature controlling means which is capable of actively controlling the temperature of the luminescent layer and consequently, as discussed previous, the exact second color distribution of the luminescent layer. By altering the temperature of the luminescent layer, the color distribution of the total light emission of the color tunable lighting assembly is altered and, as such, the color of the emitted light. If the temperature increases more light at higher wavelengths is emitted. Thus, the emitted light becomes more red. Hence, the temperature controlling means is an effective means to alter the color of the emitted light, and, thus, to control the specific color distribution of the light emitted by the color tunable lighting assembly. Thus, the specific color distribution is dependent on the temperature of the luminescent layer.

For example, if the color tunable lighting assembly has to emit a specific color, the temperature controlling means controls the luminescent layer to a specific temperature at which the combination of the not absorbed portion of the first color distribution and the second color distribution is substantially has a color point substantially matching with the specific color.

The luminescent material absorbs light in accordance with their absorption distribution. The absorption distribution has also a slight dependence on the operational temperature of the luminescent material, however, the effect of this temperature dependency on the specific color distribution of the color tunable lighting assembly is relatively low compared to the effect of the temperature dependency of the light emission distribution.

It is to be noted that the temperature controlling means is capable of actively controlling a temperature of the luminescent layer. This means that the temperature controlling means is an active device which is capable of actively influencing the temperature of the luminescent layer to a specific temperature. The actively controlling also means that the temperature controlling means uses energy to control the temperature. The use of energy may be continuously, or only temporarily, when the controlling of certain parameters is only required during a limited amount of time. Passive cooling fins are not regarded as temperature controlling means for controlling a temperature of the luminescent layer.

The light emitter may be any type of light emitter, and in certain embodiments a solid state light emitter is used, such as a Light Emitting Diode, an organic light emitting diode, or, for example, a laser diode. Further, a plurality of light emitters may be provided in the color tunable lighting assembly each emitting the first color distribution or emitting different color distributions. The light emitter itself may also comprise luminescent material, such as organic or inorganic phosphors, to obtain a light emission having the first color distribution.

Optionally, the temperature controlling means is configured to increase the temperature of the luminescent layer to increase a mean wavelength of the second color distribution. As discussed previously, an increase of the temperature of the luminescent layer results a shift of the light emission distribution of the luminescent material towards higher wavelengths, and, thus, the mean wavelength of the second color distribution shifts towards a higher wavelength. Depending on the specific color distribution of the color tunable lighting assembly as a whole, the correlated color temperature of the specific color distribution may increase or decrease.

The color temperature of a specific light emission of white light is the temperature of a black body that radiates the specific light emission. If the color point of a light emission is not exactly a point on the black body line in a color space, the color point may still be experienced by the human naked eye as white light of a specific color temperature—than, the term correlated color temperature is used to indicate that the color point resembles white light with a specific color temperature and the value of the specific color temperature of the white light is than the value of the correlated color temperature.

Optionally, the color tunable lighting assembly comprises a further luminescent layer which receives light of the first color distribution and/or the second color distribution. The further luminescent layer comprises further luminescent material to absorb a portion of the light of the first color distribution and/or the second color distribution and to convert a portion of the absorbed light into light of a third color distribution. The third color distribution is dependent on the temperature of the further luminescent layer. Use of the further luminescent layer allows the creation of other (and more) colors by the color tunable lighting assembly because the light emission of the color tunable lighting assembly comprises also light of the third color distribution. Further, the color rendering index of the light emitted by the color tunable lighting assembly increases because of the addition light of the third color distribution.

Optionally, the temperature controlling means is also configured to control a temperature of the further luminescent layer to obtain the specific color distribution.

Optionally, the color tunable lighting assembly comprises a further temperature controlling means for controlling a temperature of the further luminescent layer to obtain the specific color distribution. The use of the further temperature controlling means provides an additional parameter to tune the color of the light emitted by the color tunable lighting assembly. In accordance with the previously discussed effect of a shift of the third color distribution (in dependence of the temperature of the further luminescent layer), the light emission by the color tunable lighting assembly changes if the temperature of the further luminescent layer changes.

Optionally, at least one of the luminescent material and the further luminescent material comprises at least one of an organic phosphor, an inorganic phosphor and quantum dots. The provided options for the luminescent material and the further luminescent material are effective and efficient luminescent materials to convert light of a first color distribution into light of another color distribution. The absorption distributions and light emission distributions of organic phosphors and inorganic phosphors are relatively wide and, if they shift in dependence of a temperature change, a color point of the total light emission of the color tunable lighting assembly changes to a nearby color point in the color space. Thus, the invention as claimed may be used to fine-tune the color point of the total light emission, which is, for example, advantageous if small tolerances in the materials and the manufacturing process must be compensated to obtain a light emission of a predefined specific color distribution. Quantum dots have a relatively wide absorption distribution and if the absorption spectrum shifts, the not-absorbed part of the light of the first color distribution only slightly changes. The light emission distribution of quantum dots is a relatively narrow spectrum, for example, a distribution with a width of 30 nanometer FWHM. If the mean of these narrow light emission spectra shifts towards another mean, the effect is that a color point of the total light emission of the color tunable lighting assembly changes to a color point that is further away from the initial color point compared to the situation in which an organic or inorganic phosphor was used. Thus, with quantum dots the color tunable lighting assembly is capable of controlling the color of the emitted color distribution to a wider range of different colors, which is advantageous if the color tunable lighting assembly is to be used as a lighting assembly to emit different colors of light.

Optionally, the temperature controlling means and/or the further temperature controlling means comprises at least one of an active heating means and an active cooling means. The invention is not limited to only reducing or only increasing the temperature of the luminescent and/or further luminescent layer—the temperature controlling means and/or the further controlling means may also comprise as well as the active heating means and the active cooling means to control the temperature of the luminescent and/or further luminescent layer to any desired temperature. The use of the term active refers to the use of energy to proving heating or to provide cooling.

Optionally, the active heating means is a resistor and/or the active cooling means is a Peltier element. If the resistor is used for heating and/or if the Peltier element is used for cooling, no moving parts are used in the temperature controlling means and/or the further temperature controlling means. Moving parts are susceptible to abrasion. Thus, the active heating means and the active cooling means according to this option result in lower maintenance costs and a longer lifetime of the color tunable lighting assembly.

Other examples of active heating means or active cooling means are a fan or the application of Synjet technology. A Synjet module creates turbulent, pulsated air-jets which can be directed precisely to location where thermal management is needed.

Optionally, a position of the luminescent layer is controllable relatively to a position of the light emitter. The temperature controlling means is configured to control the distance between the luminescent layer and the light emitter. The temperature controlling means comprises, for example, a linear motor for moving the luminescent layer and/or moving the light emitter. If the luminescent layer is closer to the light emitter, it receives more heat from the light emitter, and becomes relatively hot compared to the ambient temperature. If the luminescent layer is further away from the light emitter, its temperature remains closer to the ambient temperature. Thus, changing the distance between the luminescent layer and the light emitter is an effective measure to control the temperature of the further luminescent layer. An advantage is that no additional energy is required to heat the luminescent layer or cool the luminescent layer. Further, the position of the further luminescent layer may also be controllable relatively to the position of the light emitter and the further temperature controlling means may also be configured to control the distance between the further luminescent layer and the light emitter. The controlling of this option is also an active controlling because during a limited amount of time a motor or another moving means is provided with energy to move the luminescent layer or the light emitter to a certain position to obtain a certain distance between the luminescent layer and the light emitter.

Optionally, the temperature controlling means comprises an input means to receiving an indication of a desired color characteristic to be emitted by the color tunable lighting assembly. The temperature controlling means is configured to control the temperature of the luminescent layer to obtain the specific light emission by the color tunable lighting assembly having a color characteristic being substantially equal to the desired color characteristic. Thus, the input means receives, for example, an indication of a desired color point for the light emission of the color tunable lighting assembly, or receives an indication of a desired color temperature for the light emission of the color tunable lighting assembly. The temperature controlling means influences the temperature of the luminescent layer to obtain, as much as possible, a light emission by the color tunable lighting assembly which has such a desired color characteristic. It is to be noted that the temperature controlling means can only control the temperature of the luminescent layer within a certain bandwidth, because the second color distribution of the luminescent material can only change within a certain bandwidth, thus, in certain circumstances it may be impossible to get a light emission which exactly matches the desired color characteristic.

Optionally, the temperature controlling means comprises a temperature sensor to measure the temperature of the luminescent layer, and the temperature controlling means is configured to control the temperature of the luminescent layer in response to the measured temperature to obtain the specific color distribution (emitted by the color tunable lighting assembly). Thus, the temperature sensor provides feedback to the temperature controlling means such that the temperature controlling means is able to adjust its operation to obtain a desired temperature of the luminescent layer. If the measured temperature is too low and, thus, the temperature of the luminescent layer has to increase, the temperature controlling means, depending on its specific arrangement, actives a heater or moves the luminescent layer closer to the light emitter.

It is to be noted that, if the color tunable lighting assembly also comprises a further luminescent layer, the temperature of the further luminescent layer may be measured by a further temperature sensor. Moreover, if the color tunable lighting assembly also comprises a further temperature controlling means, the further temperature controlling means is configured to control the temperature of the further luminescent layer in response to the measured temperature (of the further luminescent layer) to obtain a specific light emission by the color tunable lighting assembly.

Optionally, the temperature controlling means comprises a light color sensor to measure a color point or a color temperature of light emitted by the color tunable lighting assembly. The temperature controlling means is configured to control the temperature of the luminescent layer in response to the measured color point or color temperature of light to obtain the specific color distribution (emitted by the color tunable lighting assembly). The light color sensor may also measure a correlated color temperature instead of the color temperature.

Moreover, if the color tunable lighting assembly comprises a further temperature controlling means, the further temperature controlling means is also configured to adjust the temperature of the further luminescent layer in response to the measured color point or (correlated) color temperature of light to obtain a specific light emission by the color tunable lighting assembly.

According to a second aspect of the invention, a light source is provided which comprises a color tunable lighting assembly according to the first aspect of the invention.

According to a third aspect of the invention, a luminaire is provided which comprises a color tunable lighting assembly according to the first aspect of the invention or comprises a light source according to the second aspect of the invention.

The light source and the luminaire according to the second and third aspect of the invention provide the same benefits as the color tunable lighting assembly according to the first aspect of the invention and have similar embodiments with similar effects as the corresponding embodiments of the system.

These and other aspects of the invention are apparent from and will be elucidated with reference to the embodiments described hereinafter.

It will be appreciated by those skilled in the art that two or more of the above-mentioned options, implementations, and/or aspects of the invention may be combined in any way deemed useful.

Modifications and variations of the system, which correspond to the described modifications and variations of the system, can be carried out by a person skilled in the art on the basis of the present description.

Figure 1A:
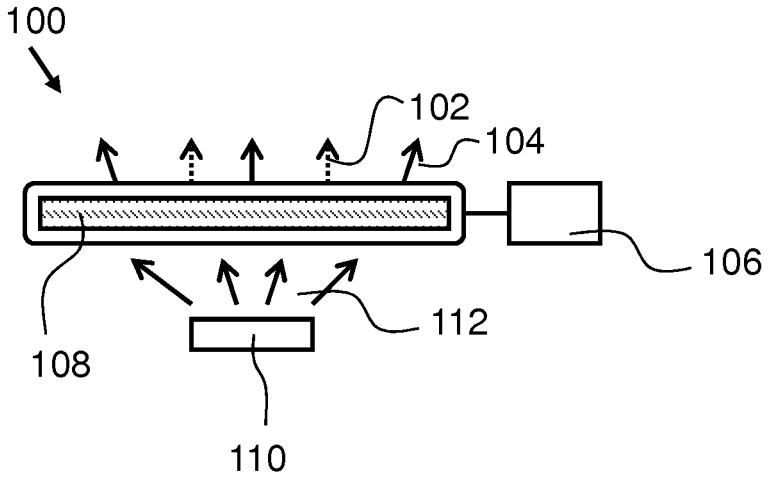
FIG. 1*a* schematically shows an embodiment of a color tunable lighting assembly according to the first aspect of the invention, FIG. 1*b* schematically shows in a chart light emission spectra and light absorption spectra, FIG. 2*a* schematically shows a shift of a light emission spectrum of quantum dots of the material CdSe in dependence of a temperature of the quantum dots.

It should be noted that items denoted by the same reference numerals in different Figures have the same structural features and the same functions, or are the same signals. Where the function and/or structure of such an item have been explained, there is no necessity for repeated explanation thereof in the detailed description.

The Figures are purely diagrammatic and not drawn to scale. Particularly for clarity, some dimensions are exaggerated strongly.

DETAILED DESCRIPTION

A first embodiment is shown in FIG. 1*a*. FIG. 1*a* schematically shows an embodiment of a color tunable lighting assembly 100 according to the first aspect of the invention. The color tunable lighting assembly 100 comprises a light emitter 110 which emits light 112 of a first color distribution. The light 112 is emitted towards a luminescent layer 108. The luminescent layer 108 comprises a luminescent material which absorbs a portion of the light 112 which it receives from the light emitter 110. Which portion of the light 112 of the first color distribution is absorbed depends on an overlap of the absorption distribution of the luminescent material with the first color distribution. The luminescent material converts a part of the absorbed light towards light 102 of the second color distribution. Light 112 of the first color distribution, and which is not absorbed by the luminescent layer 108, is also emitted as light 104 into the ambient. The color tunable lighting assembly 100 further comprises a temperature controlling means 106. The temperature controlling means 106 is configured to control a temperature of the luminescent layer 108 to obtain a light emission by the color tunable lighting assembly 100. The light emission has a specific color distribution. The specific color distribution is a combination of the light 102 of the second color distribution and light 104 which originates from the light emitter but is not absorbed by the luminescent layer 108.

The light emitter 110 may be any type of light emitter, and in certain embodiments a solid state light emitter is used, such as a Light Emitting Diode, an organic light emitting diode, or, for example, a laser diode. Further, a plurality of light emitters may be provided in the color tunable lighting assembly each emitting the first color distribution or emitting different color distributions. The light emitter 110 itself may also comprise luminescent material, such as organic or inorganic phosphors, to obtain a light emission having the first color distribution.

The luminescent material of the luminescent layer 108 may be an organic phosphor, an inorganic phosphor or quantum dots.

Figure 1B:
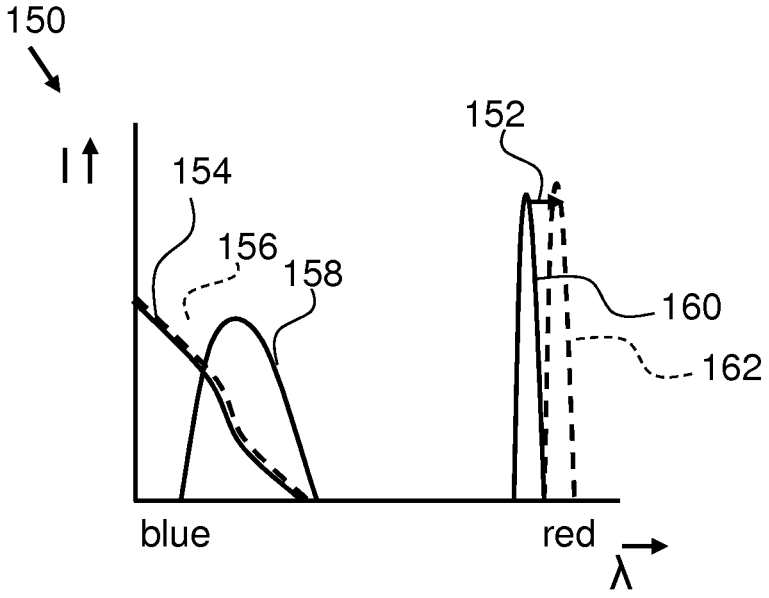

FIG. 1*b* schematically shows in a chart 150 light emission spectra 158, 160, 162 and light absorption spectra 154, 156. The terms light emission/absorption spectra and the term light emission/absorption distributions are used interchangeable in this document. An x-axis of the chart 150 represents a wavelength of (visible) light. A left end of the x-axis represents the wavelength of blue light and the right end of the x-axis represents the wavelength of red light. A y-axis of the chart 150 represents the intensity of light. The bottom end of the y-axis is intensity 0. The first light emission spectrum 158 is the first color distribution that is emitted by the light emitter 110. Thus, the light emitter 110 emits blue light. A first absorption spectrum 154 is the absorption spectrum of an example of a luminescent material at room temperature, e.g. 20 degrees Celsius. At room temperature, the overlap between the first light emission spectrum 158 and the first absorption spectrum 154 represents the absorbed portion of light by the luminescent material. A remaining portion of the first light emission spectrum 158 is not absorbed and emitted by the color tunable lighting assembly into the ambient. A relatively large portion of the absorbed light is converted into light of the second color spectrum by the luminescent material. At room temperature the second light emission spectrum 160 is the light emission spectrum of the luminescent material, and is, thus, the second color distribution. In the example of FIG. 1*b* the second light emission spectrum is relatively narrow which may be the result of the use of quantum dots as the luminescent material.

If the temperature of the luminescent layer increases, for example, towards 150 degrees Celsius, the first absorption spectrum 154 of the luminescent material shifts with a small number of nanometers to a higher wavelength, and the luminescent material has the second absorption spectrum 156. As is seen, more blue light, which is emitted by the light emitter, is absorbed and, thus, the remaining light which is not absorbed is a smaller quantity of light and comprises less blue light at lower-blue wavelengths. However, it is to be noted that the shift light absorption spectrum is relatively small and, thus, the effect of the shift of the absorption spectrum is only marginally detectable in the total light emission by the color tunable lighting device. Because slightly more light is absorbed, slightly more light is emitted by the luminescent material. Further, the second light emission spectrum 160 of the luminescent material shifts 152 along a specific number of nanometers to a higher wavelength. At the higher temperature, as in the example, for example 150 degrees Celsius, the luminescent material emits the third light emission spectrum 162. The third light emission spectrum 162 comprises more red light and comprises more light with higher-wavelength red. Thus, the total light emission of the color tunable lighting assembly comprises at the higher temperature less blue light and more red light, the average wavelength of the blue light is slightly higher and the average wavelength of the red light is significantly higher, and, thus, the location of a color point in a color space of the emitted light shifts towards another location which is closer to red, and which has, in this specific example, a lower correlated color temperature.

It is to be noted that the invention is not limited to a partial absorption of light that is emitted by the light emitter 110. The amount of luminescent material may also be high enough such that all light that is emitted by the light emitter 110 is absorbed and converted to the second color distribution. For instance, a luminescent layer may fully convert Violet light emitted by the light emitter 110 into blue color distribution with a means wavelength of 440 nm. By controlling the temperature of the luminescent layer by the temperature controlling means 106, the converted light may shift to a higher wavelength e.g. blue light of 460 nm. Such a color tunable lighting device can be combined with, for example, direct phosphor converted LEDs or Green and Blue LEDs.

Figure 2A:
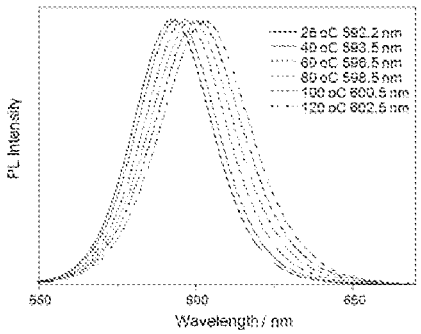
FIG. 2*b* shows another chart with light emission spectra of a color tunable lighting assembly being different for different temperatures of the luminescent layer.
FIG. 2*c* shows a further chart with light emission spectra of a color tunable lighting assembly being different for different temperatures of the luminescent layer, FIG. 3*a* schematically shows an embodiment of a color tunable lighting assembly with air heating and/or air cooling, FIG. 3*b* schematically shows an alternative embodiment of a color tunable lighting assembly with air heating and/or air cooling, FIG. 4*a* schematically shows an embodiment of a color tunable lighting assembly comprising a heating resistor, FIG. 4*b* schematically shows an embodiment of a color tunable lighting assembly comprising a Peltier element, FIG. 5*a* schematically shows an embodiment of a color tunable lighting assembly comprising two layers comprising different luminescent materials, FIG. 5*b* schematically shows another embodiment of a color tunable lighting assembly comprising two layers comprising different luminescent materials, FIG. 6*a* schematically shows an alternative embodiment of a color tunable lighting assembly comprising two layers comprising different luminescent materials, FIG. 6*b* schematically shows a chart with light absorption and light emission spectra when two different luminescent materials are provided in a color tunable lighting assembly, FIG. 7*a* schematically shows an embodiment of a color tunable lighting assembly comprising a temperature sensor, FIG. 7*b* schematically shows an embodiment of a color tunable lighting assembly comprising a light color sensor, FIG. 8 schematically shows an embodiment of a color tunable lighting assembly which controls the distance between the light emitter and the luminescent layer, FIG. 9*a* schematically shows an embodiment of a light source according to the second aspect of the invention, FIG. 9*b* schematically shows a cross-sectional view of the light source of FIG. 9*a*, and FIG. 10 schematically shows an interior of a room comprising two luminaires according to the third aspect of the invention.

FIG. 2*a* schematically shows in a chart 200 a shift of a light emission spectrum of a specific luminescent material in dependence of a temperature of the material. The specific luminescent material consists of quantum dots of the material CdSe in a ZnS shell. The core size of the CdSe particles is about 5 nm. The shown light emission spectra are measured at temperatures 26, 40, 60, 80, 100 and 120 degrees Celsius, and the mean wavelength of the light emission spectra was, respectively, 592.2, 593.5, 596.5, 598.5, 600.5 and 602.5 nanometer. Thus, a different light emission can be obtained by heating up a layer which comprises CdSe quantum dots. The presented shift in mean wavelength can be seen by the human naked eye.

Figure 2B:
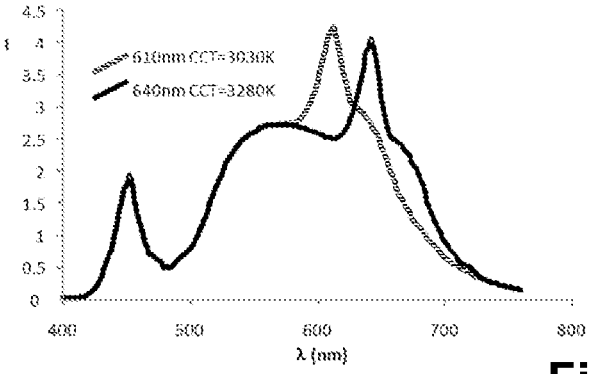
Figure 2C:
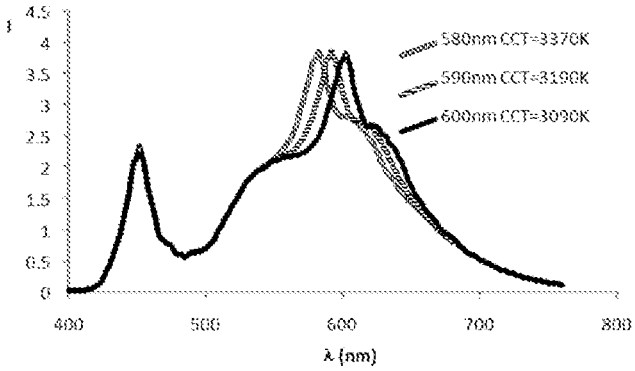

FIG. 2*b* shows a chart 230 with simulated light emission spectra of a color tunable lighting assembly. FIG. 2*c* shows a chart 260 with further simulated light emission spectra of a further color tunable lighting assembly. The simulated color tunable lighting device of both figures comprises a Light Emitting Diode (LED) which emits blue light, the inorganic phosphor YAG, and Quantum Dots (QDs) having a specific narrow light emission spectrum. In both figures, the temperature of the luminescent layer is raised and different light emission spectra in dependence of the temperature of the luminescent layer are measured.

In chart 230, a first light emission spectrum has a peak wavelength of 610 nanometer. The peak of 610 nanometer originates from a luminescent material that has a light emission spectrum that is relatively narrow and of which the exact shape and location light emission spectrum strongly depends on the temperature of the quantum dots. The correlated color temperature of the first light emission spectrum is 3030 Kelvin. After raising the temperature of the quantum dots, a second light emission spectrum with a peak wavelength of 640 nanometer is obtained, see chart 230. The shift of the peak is caused by a shift of the light emission spectrum of the luminescent material which causes the peak. The correlated color temperature of the second light emission spectrum is 3280 Kelvin. Thus, in this specific example, the correlated color temperature raises when the temperature of the luminescent layer increases.

In chart 260, a first light emission spectrum has a peak wavelength of 580 nanometer. The peak of 580 nanometer originates from a luminescent material that has a light emission spectrum that is relatively narrow and of which the exact shape and location light emission spectrum strongly depends on the temperature of the luminescent material. The correlated color temperature of the first light emission spectrum is 3370 Kelvin. After raising the temperature of the luminescent material, a second light emission spectrum with a peak wavelength of 590 nanometer is obtained, see chart 260. The correlated color temperature of the second light emission spectrum is 3190 Kelvin. After raising the temperature of the luminescent material, a third light emission spectrum with a peak wavelength of 600 nanometer is obtained, see chart 260. The correlated color temperature of the second light emission spectrum is 3090 Kelvin. It is to be noted that the shift of the peak mainly originates from a shift of the light emission spectrum of the quantum dots. Thus, in this specific example, the correlated color temperature decreases when the temperature of the luminescent layer increases.

Quantum dots are small particles of an inorganic semiconductor material that have a particles size that is less than about 30 nanometers. Examples of suitable materials are CdS, ZnSe, InAs, GaA and GaN. As discussed above, the quantum dots emit light at a particular wavelength (which also depends on the temperature of the material). A further parameter that determines the emitted wavelength is the size of the particles.

Figure 3A:
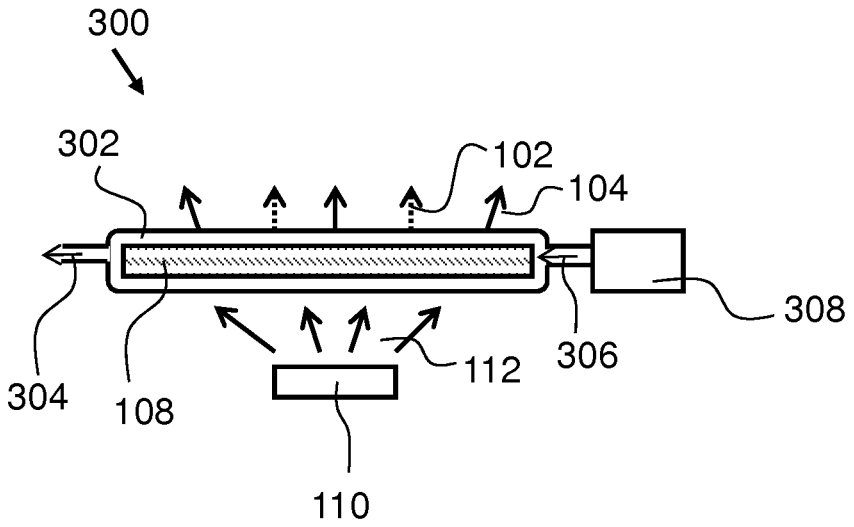

FIG. 3*a* schematically shows an embodiment of a color tunable lighting assembly 300 with air heating and/or air cooling. The color tunable lighting assembly 300 is similar to the color tunable lighting assembly 100 of FIG. 1*a*. The luminescent layer 108 is embedded in a sort of air duct 302, which means that air can freely flow along the luminescent layer 108. The air duct 302 receives heated or cooled air 306 via an inlet opening from the temperature controlling means 308. The temperature controlling means 308 comprises a heater and/or a cooler and in dependence of the required temperature for the luminescent layer 108 and the temperature of the environmental air, the heater or the cooler is activated to obtain a luminescent layer 108 of a specific temperature. At another side of the air duct 302, which is a side opposite the inlet opening, the air duct 302 has an outlet opening through which air 304 leaves the color tunable lighting assembly 300.

In another embodiment, the temperature controlling means only comprises a controllable fan or Synjet technology, which pumps a controllable amount of environmental air into the air duct 302 to cool the luminescent layer 108. A Synjet module create turbulent, pulsated air-jets which can be directed precisely to location where thermal management is needed. The luminescent layer 108 is, in use, heated up by the luminescent material. During the conversion of light a small portion of the absorbed light is converted into heat. By pumping a specific amount of environmental air through the air duct 302, the luminescent layer 108 is kept at a specific temperature.

Figure 3B:
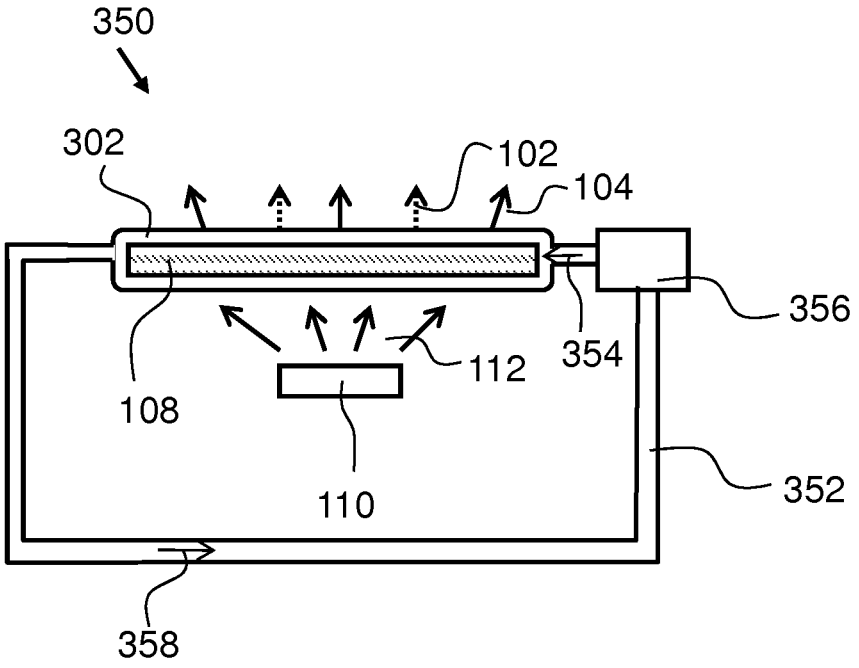

FIG. 3*b* schematically shows an alternative embodiment of a color tunable lighting assembly 350 with air heating and/or air cooling. The color tunable lighting assembly 350 is similar to the color tunable lighting assembly 300 of FIG. 3*a*, however, the air which leaves the air duct 302 through the outlet opening of the air duct 302 is transported by a tube 352 back to a temperature controlling means 356 which comprises a heater and/or cooler. Especially, if the temperature of the luminescent layer 108 has to be significantly lower or higher than the environmental temperature, it is efficient to re-use the air which leaves the air duct 302 because this air shall have a temperature close to the temperature of the luminescent layer 108. Furthermore, in another embodiment, the temperature controlling means 356 has a temperature sensor which measures the temperature of air which returns via the tube 352. The measured temperature is an indication of the temperature of the luminescent layer 108 and the temperature controlling means 356 uses the measured value as an input for changing the temperature of the air 354 which is provided via the inlet opening to the air duct 302 to obtain a specific temperature for the luminescent layer 108.

The embodiments of FIG. 3*a* or 3*b* are not limited to air only. Fluids may be used as well to heat or cool the luminescent material.

Figure 4A:
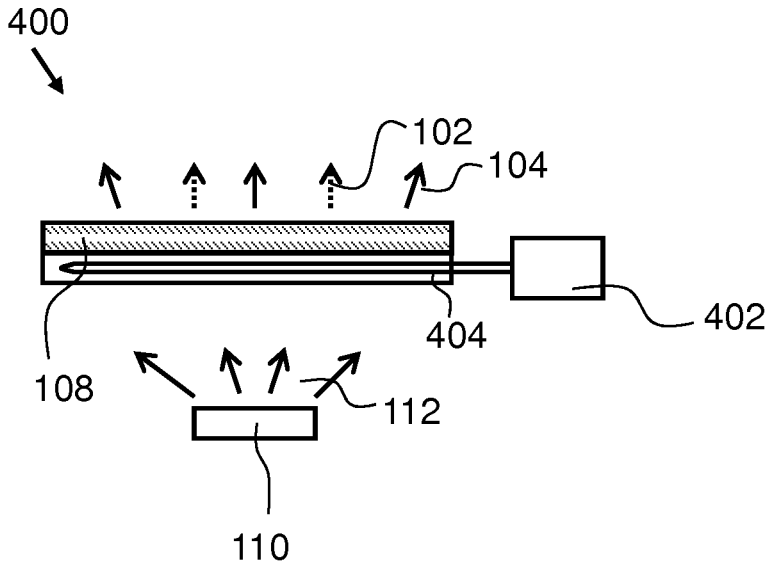

FIG. 4*a* schematically shows an embodiment of a color tunable lighting assembly 400 comprising a heating resistor 404. The color tunable lighting assembly 400 is similar to the color tunable lighting device 100 of FIG. 1*a*. A difference is that the temperature controlling means 402 comprises a heating resistor 404. The heating resistor 404 comprises a thin wire which is thermally coupled to a surface of the luminescent layer 108 that is facing the light emitter 110. The heating resistor 404 is embedded in a transparent material such that almost no light is blocked. When the temperature control means 402 provides a current to the heating resistor 404, the luminescent layer 108 is heated up. It is to be noted that the heating resistor 404 may also be provided at another surface of the luminescent layer 108, such as the surface through which light is emitted into the ambient.

Figure 4B:
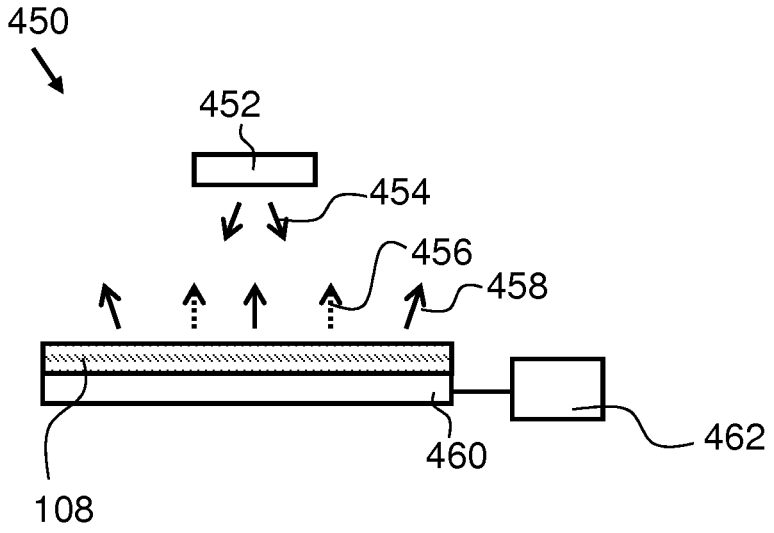

FIG. 4*b* schematically shows an embodiment of a color tunable lighting assembly 450 comprising a Peltier element 460. Further, the color tunable lighting assembly 450 is arranged in a reflection arrangement, which means that a light emitter 452 is arranged at the same side of the luminescent layer 108 at which light 456, 458 is emitted into the ambient.

The color tunable lighting assembly 450 comprises a luminescent layer 108 such as the one that is discussed in the context of FIG. 1*a* and FIG. 1*b*. The luminescent layer 108 is brought in contact with a Peltier element 460. The Peltier element 460 is an active element which is capable of transporting heat away from the luminescent layer 108. The Peltier element 460 is controlled by a temperature controlling mean 462 which provides a specific amount of electrical energy to the Peltier element 460 which allows the Peltier element 460 to transport a specific amount of heat away from the luminescent layer 108 such that the luminescent layer 108 obtains a specific temperature. Thus, the luminescent layer 108 is actively cooled. The light emitter 452 is arranged at another side of the luminescent layer 108 than a side at which the Peltier element 460 is arranged. The light emitter 452 emits light 454 of a first color distribution towards the luminescent layer 108. A portion of the light 454 may be absorbed by the luminescent material and converted to light 456 of the second color distribution. A non-absorbed portion of light 458 is reflected by the luminescent layer 108. A surface of the Peltier element 460 which is in contact with the luminescent layer 108 may be reflective such that light that is generated within the luminescent layer 108 and is emitted towards the Peltier element 460 is reflected back towards the luminescent layer 108 and, consequently, to the ambient. It is to be noted that the light emitter 452 is not by definition directly above the luminescent layer 108 such that is partly block emitted light 456, 458. The light emitter 452 may also be arranged at the left or right side of the luminescent layer such that it is not in the middle of the light emission of the color tunable lighting assembly 450 and is arranged such that it is able to emit light towards the luminescent layer 108.

Figure 5A:
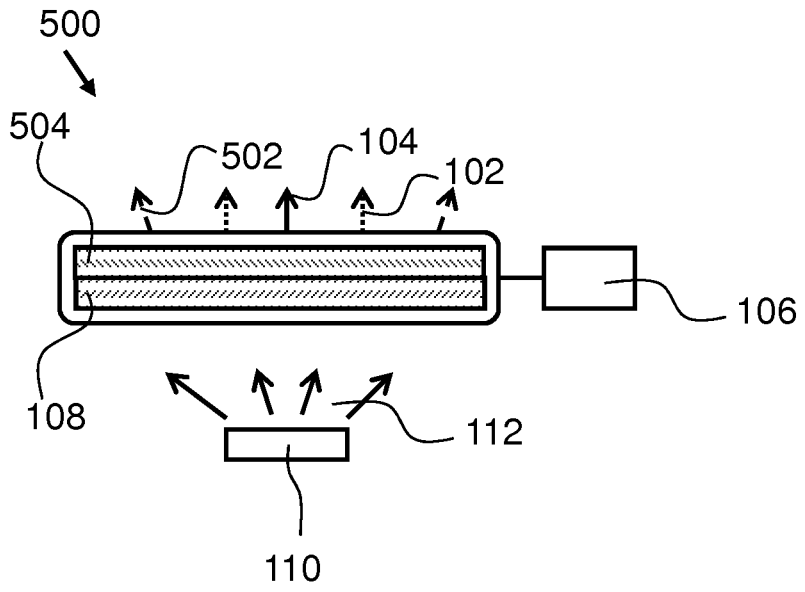

FIG. 5*a* schematically shows an embodiment of a color tunable lighting assembly 500 comprising two layers 108, 504 comprising different luminescent materials. The structure of the color tunable lighting assembly is similar to the color tunable lighting assembly 100 of FIG. 1*a*. A difference is that two luminescent layer 108, 504 are provided in the color tunable lighting assembly 100. A first luminescent layer 108 is similar to the luminescent layer 108 of FIG. 1*a* and FIG. 1*b*. A second luminescent layer 504 is arranged at a side of the first luminescent layer 108 which is opposite a side where the light emitter 110 is arranged. The second luminescent layer 504 comprises a further luminescent material which is different from the luminescent material of the first luminescent layer 108. Light which is emitted by the first luminescent layer 108 towards the second luminescent layer 504 comprises (not absorbed) light of the first color distribution and light 102 of the second color distribution. The further luminescent material absorbs a portion of the light which it receives from the first luminescent layer 108 in accordance with its absorption spectrum. The absorbed light is converted, according to the light emission spectrum of the further luminescent material, towards light 502 of the third color distribution. The final light output of the color tunable lighting assembly comprises the not absorbed light 104 and not absorbed spectral components of light the first color distribution, light 102 of the second color distribution and spectral components of light of the second color distribution that are not absorbed by the further luminescent material, and light 502 of the third color distribution.

The first luminescent layer 108 and the second luminescent layer 504 are in direct contact and, as such, the temperature controlling means 106 is configured to control the temperature of the first luminescent layer 108 as well as the temperature of the second luminescent layer 504 to obtain a specific light emission by the color tunable lighting device 500.

It is to be noted that in the embodiment of FIG. 5*a* the two different luminescent materials are arranged in separate layers. In another embodiment, they may be mixed and arranged in a single luminescent layer. Furthermore, more than two luminescent materials may be mixed in a single luminescent layer.

Figure 5B:
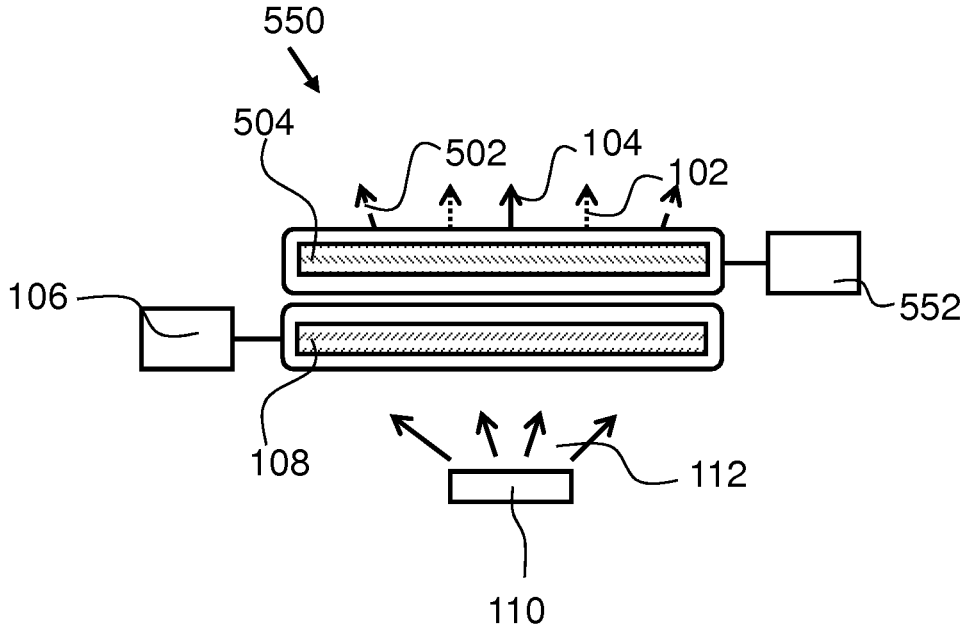

FIG. 5*b* schematically shows another embodiment of a color tunable lighting assembly 550 comprising two layers 108, 504 comprising different luminescent materials. The arrangement of the color tunable lighting assembly 550 is similar to the arrangement of the color tunable lighting assembly 100 of FIG. 1*a*. A difference is that the first luminescent layer 108 is not in direct contact with the second luminescent layer 504, and, consequently, the temperature of each one of the luminescent layer 108, 504 can be controlled independently. Another difference is that the color tunable lighting assembly 550 comprises a further temperature controlling means 552 to control the temperature of the second luminescent layer 504 to influence the exact light absorption and light emission spectra of the further luminescent material. Thus, the light output of the color tunable lighting assembly can continuously controlled by controlling two different parameters: the temperature of the first luminescent layer 108 and the temperature of the second luminescent layer 504. It is to be noted that the further temperature controlling means 552 may also comprise a cooler, a heater, a fan, a heating resistor, a Peltier element, etc. in accordance with previously discussed embodiments of the first temperature controlling means 108.

Figure 6A:
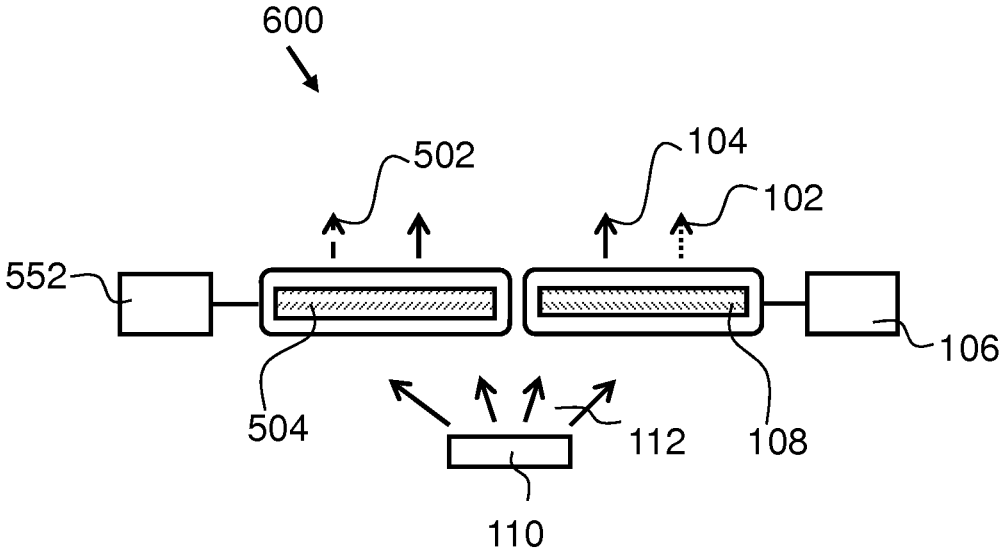

FIG. 6*a* schematically shows an alternative embodiment of a color tunable lighting assembly 600 comprising two layers 108, 504 comprising different luminescent materials. In the color tunable lighting assemblies 500, 550 the second luminescent layer 504 received light from the first luminescent layer 108. This has been changed in the color tunable lighting assembly 600, but for the rest the color tunable lighting assembly 600 is equal to the color tunable lighting assembly 550. In the color tunable lighting assembly 600, the first luminescent layer 108 and the second luminescent layer 504 are arranged besides each other, which means that, each luminescent layer 108, 504 is arranged in a part of the light beam emitted by the light emitter 110 and their parts of the light beam do not overlap. In the color tunable lighting assembly 550 the layers fully overlap. In yet another alternative embodiment, the first luminescent layer 108 and the second luminescent layer 504 partly overlap within the light beam emitted by the light emitter 110.

In an alternative embodiment, more than two luminescent layer are arranged in the color tunable lighting assembly 500, 550, 600. The color tunable lighting assemblies may have a single temperature controlling means or a plurality of temperature controlling means. If multiple temperature controlling means are provided, temperatures of different luminescent layers may be controlled independently of each other.

Figure 6B:
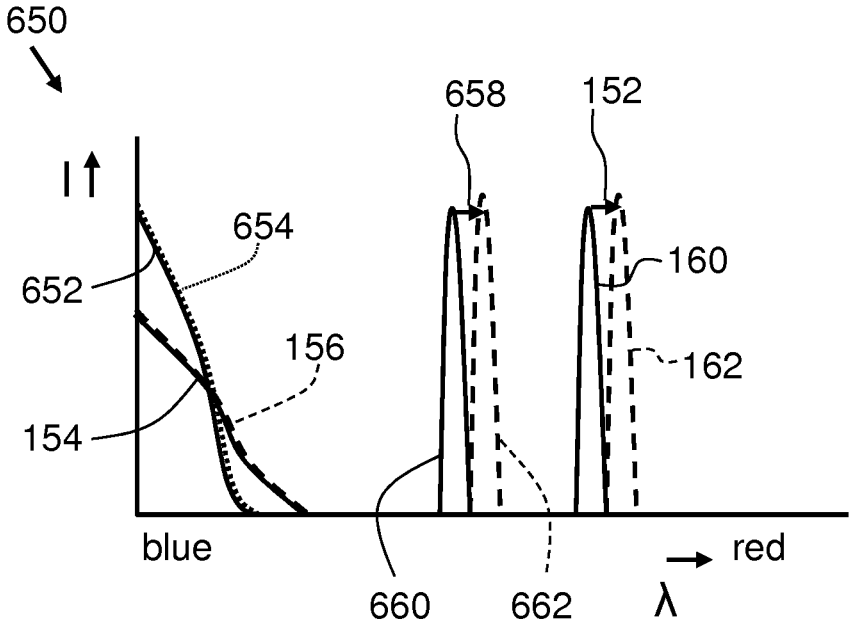

FIG. 6*b* schematically shows a chart 650 with light absorption spectra 154, 156, 652, 654 and light emission spectra 660, 662, 160, 162 of the two different luminescent materials which are provided in a color tunable lighting assemblies 500, 550, 600. The chart 650 is similar to the chart 150 of FIG. 1*b*. For reasons of clarity, the first color distribution 158 of the light emitted by the light emitter 110 is not drawn.

The luminescent material of the first luminescent layer 108 has an absorption spectrum 154 at room temperature. If the temperature of the first luminescent layer 108 increases, for example, to 150 degrees Celsius, the absorption spectrum shifts with a specific number of nanometers to a higher wavelengths and the absorption spectrum of the luminescent material is the absorption spectrum 156. The light emission spectrum 160 is the light emission spectrum of the luminescent material of the first luminescent layer 108 at room temperature. If the first luminescent layer 108 becomes relatively warm, e.g. 150 degrees Celsius, the light emission spectrum 160 shifts towards a light emission spectrum 162 at higher wavelengths.

The further luminescent material of the second luminescent layer 504 has an absorption spectrum 652 at room temperature. If the temperature of the second luminescent layer 504 increases, for example, to 150 degrees Celsius, the absorption spectrum shifts with a specific number of nanometers to a higher wavelengths and the absorption spectrum of the further luminescent material is the absorption spectrum 654. The light emission spectrum 660 is the light emission spectrum of the further luminescent material of the second luminescent layer 504 at room temperature. If the second luminescent layer 504 becomes relatively warm, e.g. 150 degrees Celsius, the light emission spectrum 660 shifts 658 towards a light emission spectrum 662 at higher wavelengths.

The light emission spectra 160, 162, 660, 662 of the luminescent material and the further luminescent material are relatively narrow. Such light emission spectra may be obtained by using quantum dots as the luminescent material.

The color tunable lighting devices 550 and 600 can independently control the temperature change of the first luminescent layer 108 and the second luminescent layer 504, and as such they are capable of independently controlling the shifts 152, 658 of the respective light emission spectra.

It is to be noted that the light emission spectra 152, 162 are of the luminescent material of the first luminescent layer 108 and that the light emission spectra 660, 662 are of the further luminescent material of the second luminescent layer 504. However, in another embodiment it may also be the other way around: the luminescent material of the first luminescent layer 108 has depending of its temperature light emission spectra 660, 662, and the further luminescent material of the second luminescent layer 504 has light emission spectra 160, 162.

Figure 7A:
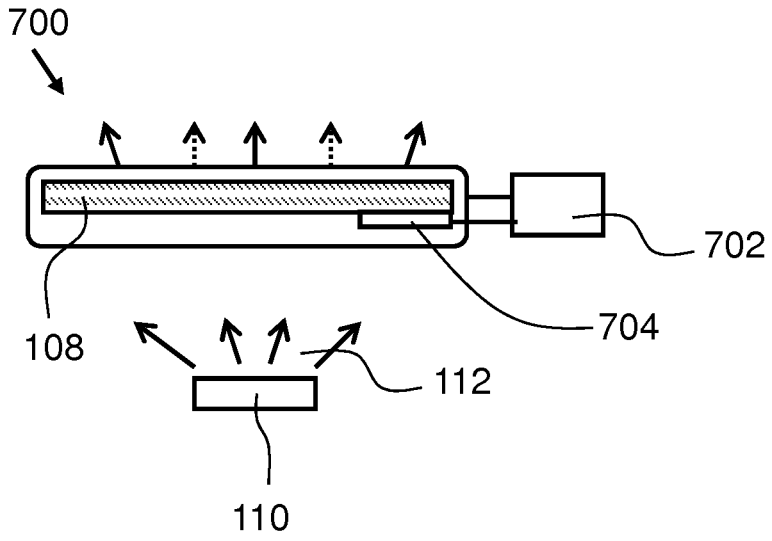

FIG. 7*a* schematically shows an embodiment of a color tunable lighting assembly 700 comprising a temperature sensor 704. The color tunable lighting assembly 700 is similar to the color tunable lighting assembly 100 of FIG. 1*a*, however, the temperature controlling means 702 is different and is provided with a temperature sensor 704. The temperature sensor 704 is arranged in the close proximity of the luminescent layer 108 such that the temperature sensor 704 measures the temperature of the luminescent layer 108. The temperature sensor 704 provides a signal which indicates the actual temperature of the luminescent layer 108. The signal is used by the temperature controlling means 702 to control the temperature of the luminescent layer 108. For example, if the temperature controlling means 702 is configured to keep the luminescent layer 108 at a specific temperature, the deviation of the measured temperature and the specific temperature is used to provide heat to the luminescent layer 108 or to cool the luminescent layer 108. Heating and cooling may be done with different means which are discussed previously Thus, the temperature sensor 704 is used in a feedback loop which allows the accurate control of the temperature of the luminescent layer 108 by the temperature controlling means 702. The temperature controlling means 702 may also comprise an input means which receives a desired temperature for the luminescent layer 108. The deviation between the received desired temperature and the measured temperature is used to heat or cool the luminescent layer 108.

Figure 7B:
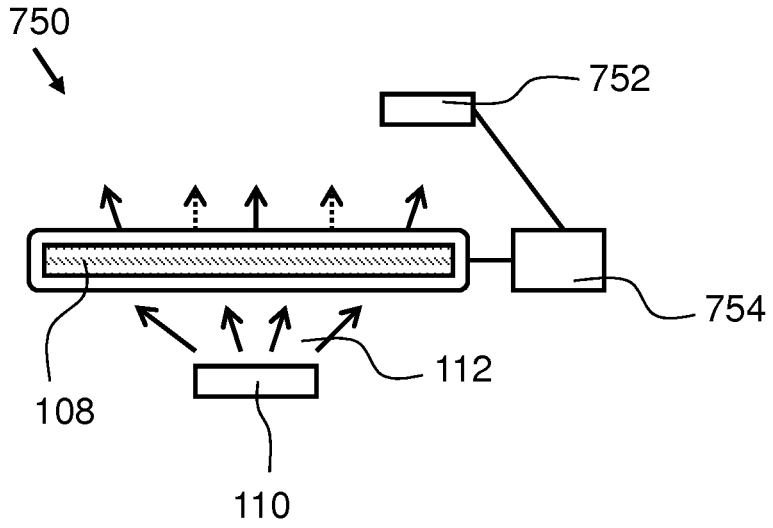

FIG. 7*b* schematically shows an embodiment of a color tunable lighting assembly 750 comprising a light color sensor 752. The color tunable lighting assembly 750 is similar to the color tunable lighting assembly 100 of FIG. 1*a*, however, the temperature controlling means 754 is different and is provided with a color sensor 752. The color sensor 752 is arranged in the light emission of the color tunable lighting assembly 750 such that the emitted color distribution (partly) impinges on the color sensor 752. The color sensor 752 is configured to measure a color point in a color space of the emitted color distribution and/or to measure a correlated color temperature of the emitted color distribution. The color sensor 752 generates a signal which indicates the actual color point and/or the actual correlated color temperature of the emitted light. The signal is used by the temperature controlling means 754 to control the temperature of the luminescent layer 108. If, for example, the measured correlated color temperature is too high, the luminescent layer 108 must be heated up such that the light emission of the color tunable lighting assembly 750 comprises less light of lower wavelengths (blue light) and comprises more light of higher wavelengths (yellow orange red light). If, for example, the measured correlated color temperature is too low, the luminescent layer 108 must be cooled such that the light emission of the color tunable lighting assembly comprises more light of lower wavelengths (blue light) and comprises less light of higher wavelengths (yellow orange red light). The temperature controlling means 754 may also comprise an input means which receives a desired color point or a desired correlated color temperature for the light emission of the color tunable lighting assembly 750. The difference between the measured color point and/or measured correlated color temperature and the desired color point and/or desired correlated color temperature is used to control the temperature of the luminescent layer 108.

It is to be noted that, in case the color tunable lighting assembly 750 comprises a plurality of temperature controlling means, each temperature controlling means may comprise a temperature sensor and/or a color sensor in accordance with the embodiments of FIG. 7*a* and FIG. 7*b* and they each may comprise a an input means. If there are a plurality of temperature controlling means, the temperature sensor and/or the color sensor and/or the input means may also be shared by the different temperature controlling means.

Figure 8:
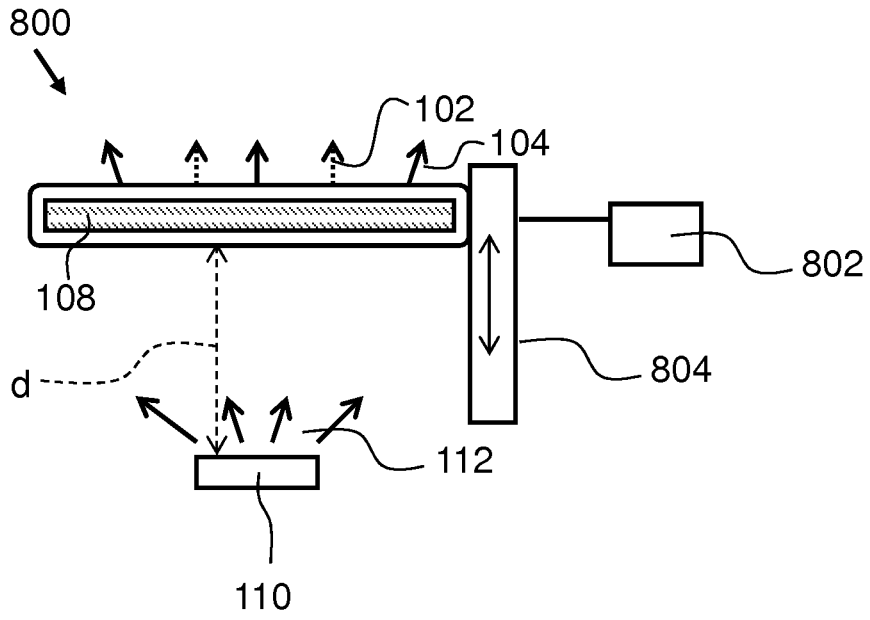

FIG. 8 schematically shows an embodiment of a color tunable lighting assembly 800 which controls the distance d between the light emitter 110 and the luminescent layer 108. The color tunable lighting assembly 800 is similar to the color tunable lighting assembly 100 of FIG. 1*a*. The main difference is that the position of the luminescent layer 108 may be changed with a linear motor 804 such that the distance between the light emitter 110 and the luminescent layer 108 can be controlled. The light emitter 110 becomes, in general, in use, relatively hot. This heat may be used to heat the luminescent layer 108. By moving the luminescent layer 108 relatively close to the light emitter 110, the luminescent layer 108 receives a relatively large amount of heat from the light emitter 110 and becomes also warm. By moving the luminescent layer 108 away from the light emitter 110, the luminescent layer 108 receives less heat and becomes cooler. Thus, the temperature controlling means 802 controls the linear motor 804 to change the distance d between the luminescent layer 108 and the light emitter 110 thereby controlling the temperature of the luminescent layer 108. In an alternative embodiment, the linear motor is coupled to the light emitter 110 for moving the light emitter 110 towards or away from the luminescent layer 108.

When the color tunable lighting assembly 800 is switched on, the light emitter 110 and the luminescent layer 108 have the same temperature as the ambient. In an embodiment, if the luminescent layer 108 has to obtain a significant higher temperature than the ambient temperature, the luminescent layer 108 is moved to a position nearby the light emitter 110 at the moment that the color tunable lighting assembly 800 is switched on. After some time, the luminescent layer 108 is heated up to a high enough level by the light emitter 110, and is the luminescent is moved to a position at which the luminescent layer 108 receives the same amount of heat from the light emitter 110 as the amount of heat that is lost by the luminescent layer 108 by means of radiation, convection and conduction.

Figure 9A:
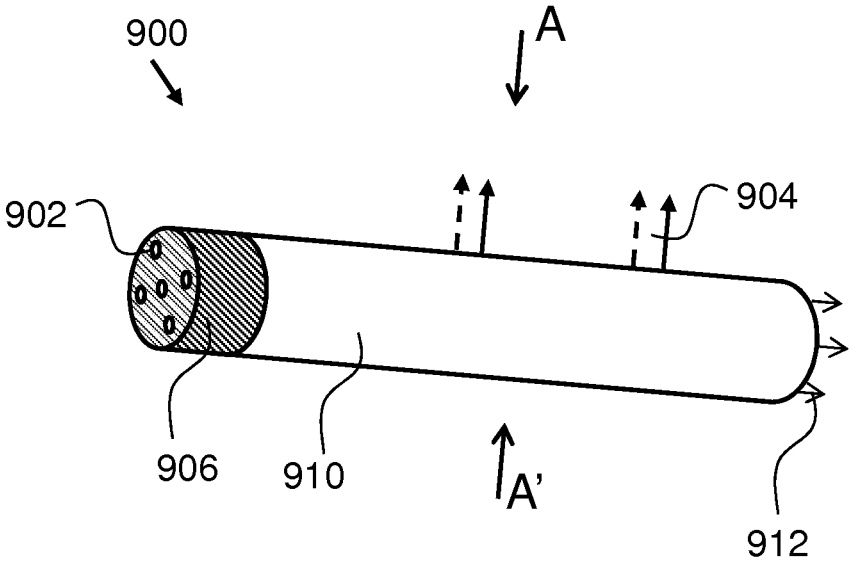
Figure 9B:
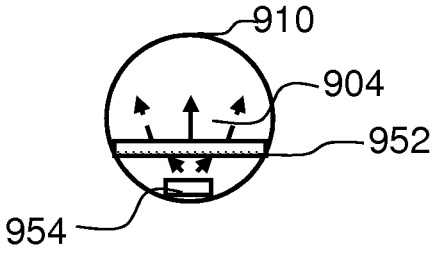

FIG. 9*a* schematically shows an embodiment of a light source 900 according to the second aspect of the invention. FIG. 9*b* schematically shows a cross-sectional view of the light source 900 of FIG. 9*a* along a line A-A'. The light source 900 has the shape of a light tube. The light source 900 comprises a long transparent tube 910 in which light emitters 954 and a luminescent layer 952 is provided. At one end of the transparent tube 910 a cylindrical temperature controlling means 906 is coupled to the transparent tube 910. The temperature controlling means 906 comprises air inlet holes 902. The temperature controlling means 906 blows air of a specific temperature into the transparent tube 910 to heat or cool the luminescent layer 952. At another end of the transparent tube 910, the air 912 is blown into the ambient. As shown in FIG. 9*b*, the light emitter 954 emits light of a first color distribution towards the luminescent layer 952 which comprises a luminescent material for converting at least a portion of the received light of the first color distribution towards light of a second color distribution. The emission spectrum of the luminescent material depend on the temperature of the luminescent material.

The shape of light source 900 is not limited to the shape of a tube. Other shapes are possible as well, such as traditional light bulbs or flat large area light sources.

In another embodiment, the color tunable lighting assembly may be positioned next to another lighting assembly. For instance the color tunable lighting assembly may tune the bluish part of the spectrum (e.g. switching between 440 en 460 nm) while the second light source provides light e.g. in the yellow and red part of the spectrum. In this way a lighting arrangement providing white light and controlling (i.e. spectral tuning) part of the light is obtained.

Figure 10:
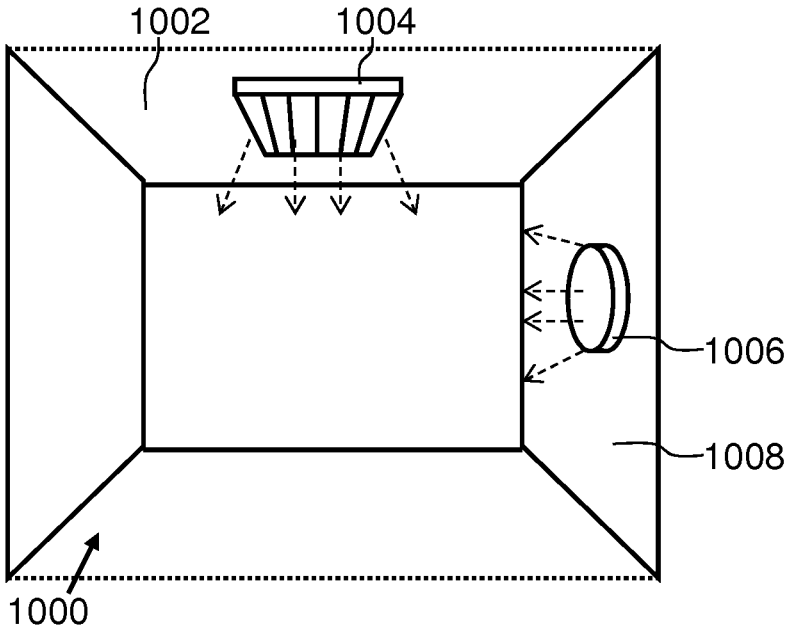

FIG. 10 schematically shows an interior of a room 1000 comprising two luminaires 1004, 1006 according to the third aspect of the invention. At the roof 1002 of the room is provided a first luminaire 1004 which comprises, for example, a plurality of light source 900 of FIG. 9*a* and FIG. 9*b*. At the wall 1008 is provided another luminaire 1006 which comprises, for example, a color tunable lighting assembly according to the first aspect of the invention.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A color tunable lighting assembly, the color tunable lighting assembly comprising:

a light emitter being configured to emit light of a first color distribution;

a luminescent layer for receiving the light emitted by the light emitter, the luminescent layer comprising luminescent material for absorbing a portion of the light of the first color distribution and converting a portion of the absorbed light into light of a second color distribution, the second color distribution being dependent on a temperature of the luminescent layer, the luminescent material comprising quantum dots; and a temperature controlling unit for actively controlling the temperature of the luminescent layer to obtain a light emission by the color tunable lighting assembly, the light emission having a specific color distribution;

wherein the temperature controlling unit is configured to increase the temperature of the luminescent layer for increasing a mean wavelength of the second color distribution and wherein the temperature controlling unit is bound to said luminescent layer to form an integrated structure in said assembly.

2. A color tunable lighting assembly according to claim 1, wherein the temperature controlling unit comprises at least one of an active heating unit and an active cooling unit.

3. A color tunable lighting assembly according to claim 2, wherein the active heating unit is a resistor and/or the active cooling unit is a Peltier element.

4. A color tunable lighting assembly according to claim 1, wherein the temperature controlling unit is configured to receive an indication of a desired color characteristic to be emitted by the color tunable lighting assembly.

5. A color tunable lighting assembly according to claim 1, wherein the temperature controlling unit comprises a temperature sensor for measuring the temperature of the luminescent layer, and the temperature controlling unit is configured to control the temperature of the luminescent layer in response to the measured temperature.

6. A light source device comprising the color tunable lighting assembly according to claim 1.

7. A luminaire comprising the color tunable lighting assembly according to claim 1.

8. A color tunable lighting assembly, the color tunable lighting assembly comprising:

a light emitter being configured to emit light of a first color distribution;

a luminescent layer for receiving the light emitted by the light emitter, the luminescent layer comprising luminescent material for absorbing a portion of the light of the first color distribution and converting a portion of the absorbed light into light of a second color distribution, the second color distribution being dependent on a temperature of the luminescent layer;

a temperature controlling unit for actively controlling the temperature of the luminescent layer to obtain a light emission by the color tunable lighting assembly, the light emission having a specific color distribution, wherein the temperature controlling unit is configured to increase the temperature of the luminescent layer for increasing a mean wavelength of the second color distribution; and a further luminescent layer for receiving light of at least one of the first color distribution and the second color distribution, the further luminescent layer comprising further luminescent material for absorbing a portion of the light of at least one of the first color distribution or the second color distribution and converting a portion of the light absorbed by the further luminescent layer into light of a third color distribution, the third color distribution being dependent on a temperature of the further luminescent layer.

9. A color tunable lighting assembly according to claim 8, wherein the temperature controlling unit is also configured to control the temperature of the further luminescent layer to obtain the specific color distribution, or wherein the color tunable lighting assembly comprises a further temperature controlling unit for controlling the temperature of the further luminescent layer to obtain the specific color distribution.

10. A color tunable lighting assembly according to claim 8, wherein the further luminescent material comprises at least one of an organic phosphor, an inorganic phosphor and quantum dots.

11. A color tunable lighting assembly, the color tunable lighting assembly comprising:

a light emitter being configured to emit light of a first color distribution;

a luminescent layer for receiving the light emitted by the light emitter, the luminescent layer comprising luminescent material for absorbing a portion of the light of the first color distribution and converting a portion of the absorbed light into light of a second color distribution, the second color distribution being dependent on a temperature of the luminescent layer; and a temperature controlling unit for actively controlling the temperature of the luminescent layer to obtain a light emission by the color tunable lighting assembly, the light emission having a specific color distribution, wherein a position of the luminescent layer is controllable relative to a position of the light emitter, and the temperature controlling unit is configured to control a distance (d) between the luminescent layer and the light emitter for controlling the temperature of the luminescent layer.

12. A color tunable lighting assembly, the color tunable lighting assembly comprising:

a light emitter being configured to emit light of a first color distribution;

a luminescent layer for receiving the light emitted by the light emitter, the luminescent layer comprising luminescent material for absorbing a portion of the light of the first color distribution and converting a portion of the absorbed light into light of a second color distribution, the second color distribution being dependent on a temperature of the luminescent layer; and a temperature controlling unit for actively controlling the temperature of the luminescent layer to obtain a light emission by the color tunable lighting assembly, the light emission having a specific color distribution, wherein the temperature controlling unit is configured to increase the temperature of the luminescent layer for increasing a mean wavelength of the second color distribution, wherein the temperature controlling unit comprises a light color sensor for measuring a color point or a color temperature of light emitted by the color tunable lighting assembly, the temperature controlling unit is configured to control the temperature of the luminescent layer in response to the measured color point or color temperature of light.

* * * * *